US007111714B1

(12) United States Patent
Bell, III

(10) Patent No.: US 7,111,714 B1
(45) Date of Patent: Sep. 26, 2006

(54) SLIDE FASTENER PULL HANDLE

(75) Inventor: Thomas G. Bell, III, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 10/616,196

(22) Filed: Jul. 7, 2003

(51) Int. Cl.

| | |
|---|---|
| ***A45C 13/10*** | (2006.01) |
| ***A45C 13/28*** | (2006.01) |
| ***A41D 3/04*** | (2006.01) |
| ***A41D 13/00*** | (2006.01) |
| ***A43C 11/00*** | (2006.01) |
| ***A44B 19/26*** | (2006.01) |
| ***A44B 21/00*** | (2006.01) |

(52) U.S. Cl. ..... 190/118; 190/110; 190/903; 2/82; 2/126; 2/252; 24/387; 24/429; 36/50.1; 383/97

(58) Field of Classification Search ..... 190/118, 190/119, 903; 150/118; 383/8, 97; 24/429, 24/420, 423, 432, 387, 436; 2/82, 126, 252; 36/50.1

See application file for complete search history.

(56) References Cited

U.S. PATENT DOCUMENTS

| | | | | | |
|---|---|---|---|---|---|
| 1,872,570 | A * | 8/1932 | Cramer et al. | 190/109 |
| 2,013,847 | A * | 9/1935 | Gephardt | 2/252 |
| 2,099,853 | A * | 11/1937 | Konelsky | 150/118 |
| 2,145,118 | A * | 1/1939 | Knoess | 24/429 |
| 2,178,885 | A * | 11/1939 | Buff et al. | 24/382 |
| 2,268,003 | A * | 12/1941 | Walters | 24/439 |
| 2,297,657 | A * | 9/1942 | Hollier | 36/50.1 |
| 2,330,224 | A * | 9/1943 | Hollier | 36/50.1 |
| 2,437,099 | A * | 3/1948 | Krupp | 150/107 |
| 2,690,603 | A * | 10/1954 | Welteroth | 24/440 |
| 2,987,835 | A * | 6/1961 | Forrester | 36/50.1 |
| 3,019,952 | A * | 2/1962 | Brewster | 294/142 |
| 3,589,038 | A * | 6/1971 | Sailer | 36/50.1 |
| 3,622,056 | A * | 11/1971 | Droeger | 224/153 |
| 3,628,583 | A * | 12/1971 | Poelman | 150/110 |
| 4,153,146 | A * | 5/1979 | Patton et al. | 190/103 |
| 4,213,314 | A * | 7/1980 | Trader | 70/68 |
| 4,638,579 | A * | 1/1987 | Gamm | 36/136 |
| 4,829,603 | A * | 5/1989 | Schnoor et al. | 2/69 |
| 5,136,758 | A * | 8/1992 | Wilcox et al. | 24/431 |
| 5,878,467 | A * | 3/1999 | Yokota | 24/429 |
| 6,237,152 | B1 * | 5/2001 | Gootrad | 2/87 |
| 2004/0088886 | A1 * | 5/2004 | Kerrigan | |

FOREIGN PATENT DOCUMENTS

| | | | |
|---|---|---|---|
| JP | 401023955 | A * | 1/1989 |

* cited by examiner

*Primary Examiner*—Sue A. Weaver
(74) *Attorney, Agent, or Firm*—ipsolon llp

(57) ABSTRACT

A slide fastener and related pull are disclosed. The pull is formed of an elongate strip of material defining a handle portion between a first end and an opposite second end. The first end of the pull is attached to the article bearing an elongate set of engaging structures for the slide fastener. A slide for operably engaging the set of engaging structures is attached to the pull toward the opposite second end. Accordingly, the handle portion forms an easily graspable quasi-pull chord for opening and closing the pull fastener. In a preferred embodiment, a tab portion of the pull extends from the slide attachment point on the pull to the second end of the pull, and it is detachably secured to the article when the slide fastener is in its closed position. Accordingly, the pull itself can be used as a storage device to hang objects such as a towel, a pair of shoes or the like therefrom. The pull can also serve as a protective cover for the pull fastener and have surface ornamentation thereon.

38 Claims, 5 Drawing Sheets

SLIDE FASTENER PULL HANDLE

TECHNICAL FIELD

The invention is a pull handle for a slide fastener such as a zipper or the like. In particular, the invention concerns an elongate handle for use as an easily actuated slide fastener pull that also protects the engaging portions of the slide fastener and serves as a storage device.

BACKGROUND OF THE INVENTION

Slide fasteners such as zippers and zip-lock type structures are widely used on a variety of articles including clothing, luggage and other containers. The typical slide fastener includes a pull attached to the sliding portion of the fastener to allow a user to move the sliding portion as needed to open or close an article.

For example, a typical zipper includes an elongate set of zipper teeth attached to the article adjacent to an opening in the article. A zipper slide travels along the zipper teeth to operably engage or disengage the zipper teeth depending on the direction of travel of the zipper slide. Namely, when the zipper slide is moved in a first direction along the zipper teeth, adjacent zipper teeth on opposite ends of the opening join together to essentially close the opening. The zipper slide disengages the adjacent zipper teeth when moved in a direction opposite from the first direction, thereby allowing access to the opening.

A conventional pull in a zipper is usually a short piece of metal or the like that is pivotally secured at one end to the zipper slide. A user grasps the opposite free end of the conventional pull and urges the zipper slide in the desired direction, thereby either opening or closing the zipper as desired.

Conventional slide fasteners and their pulls have been in loyal service since the 1800's; however, they still have several drawbacks. For example, slider pulls tend to move or flop around during use of the article to which the slider fastener is attached. In some situations, like when an athlete is wearing the article containing the slide faster during an athletic activity, this movement can distract the athlete or even compromise his or her performance.

Also, physically challenged individuals can have difficulty grasping and maintaining hold of a conventional pull. Similarly, people wearing outdoor gear including gloves or mittens often have trouble grasping a conventional zipper pull. Accordingly, they usually must remove their gloves or mittens to open or close a zipper. Such removal of protective gear is undesirable under some conditions such as when the zipper is on a backpack of a hiker, skier or snowboarder being used outside in inclement weather.

The engaging structures of a slide fastener, such as the teeth in a zipper, must remain free of obstructions during opening and closing of the slide fastener. Accordingly, most engaging structures on a slide fastener are exposed to an exterior surface of the article. Such exposure is often not aesthetically pleasing, and can lead to damage of these structures, particularly when the slide fastener is being used on an article intended for outdoor, rugged use.

Efforts have been made to improve the aesthetics of these structures. For example, a flap of material that usually extends from one or both sides of the article over the engaging structures is known. This flap of materials is particularly common in articles of apparel, such as in the fly on a pair of pants. While this flap tends to hide the engaging structures of the slide fastener, it also frequently becomes entangled in them. Moreover, these types of flaps tend to cover the slider pull, thereby further compromising a wearer's ability to easily grasp the pull.

In addition, conventional slider pulls do not effectively serve as a storage device for other gear or the like.

SUMMARY OF THE INVENTION

Accordingly, despite the known improvements to slide fasteners and their pulls, there remains a need for a slide fastener having a pull that allows a user to easily open and close the fastener, even if they are physically challenged or wearing gloves. Preferably, the pull also serves as a protective cover for the engaging portions of the slide fastener and provides an additional storage device for the article to which it is attached. In addition to other benefits that will become apparent in the following disclosure, the present invention fulfills these needs.

In one disclosed embodiment, the slide fastener has a pull formed of an elongate strip of material defining a handle portion between a first end and an opposite second end. The first end of the pull is attached to an article bearing an elongate set of engaging structures for the slide fastener. A slide for operably engaging the set of engaging structures is attached to the pull toward the opposite second end. Accordingly, the handle portion forms a quasi-pull chord for easy grasping by a user. Preferably, a tab portion of the pull extends from the slide attachment point on the pull to the second end of the pull, and this tab portion is detachably secured to the article when the pull and related slide fastener are in their closed positions on the article.

A user opens the slide faster by grasping the handle portion between the first and second ends of the handle and pulling the handle portion toward the base of the engaging structures. By grasping the handle portion and urging the second end of the handle along the engaging structures in a direction away from the base of the engaging structures, the user closes the slide fastener.

By detachably securing the second end of the handle to the article with the fastening structure, the handle covers and protects the engaging structures and is prevented from inadvertently opening the slide fastener. Moreover, the handle portion of the pull can serve as a holder for additional articles, such as a towel, a pair of shoes, or a coat, by extending the additional article through the handle portion and between the first and second ends.

The handle can also provide a surface for applying surface ornamentation such as a manufacturer logo or the like.

Preferably, the slide fastener is a zipper and the article containing the zipper is an article of luggage, an article of apparel, or an article of footwear.

DETAILED DESCRIPTION OF PREFERRED EMBODIMENTS

An elongate slide fastener 10 having a pull 12 that allows a user to easily open and close the slide fastener 10, even if they are physically challenged or wearing gloves is disclosed in FIGS. 1–8.

Figure 1:
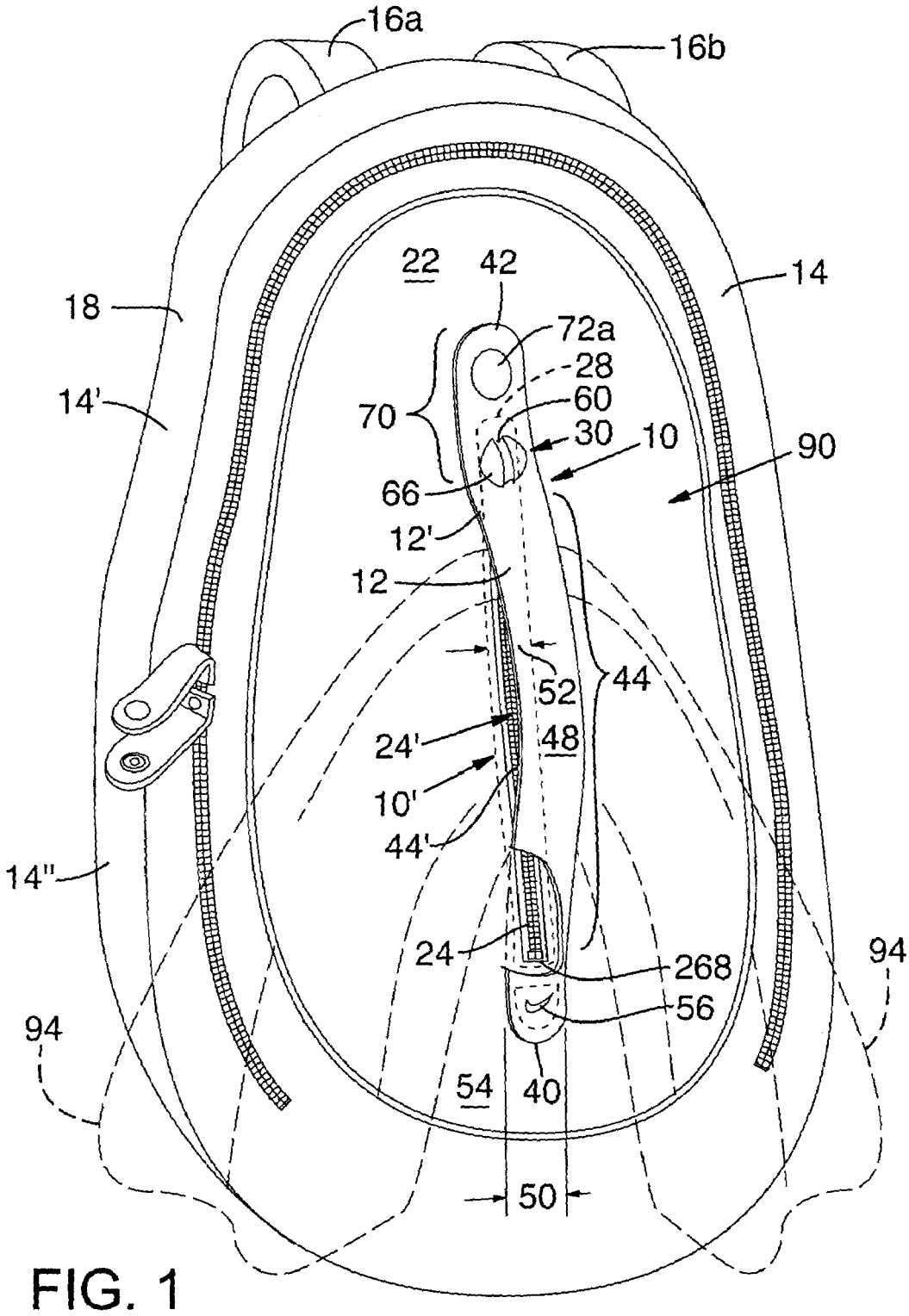
FIG. 1 is a front, isometric view of an article having a slide fastener with a pull in accordance with an embodiment of the present invention showing a possible closed position of the slide fastener and pull. The pull is shown in partial section view to show detail underneath.

Referring to FIG. 1, the slide fastener is preferably operably secured to an article 14. More preferably, the article 14 is an article of luggage 14', such as a book bag, backpack 14", nap sack (not shown) or the like. The backpack 14" preferably includes shoulder straps 16*a*, 16*b* attached to a large flexible container 18 defining at least one chamber 20 therein. An exterior surface 22 of the flexible container 18 includes the slide fastener 10, which is preferably aligned substantially vertically on the exterior surface 22 of the flexible container 18.

Figure 2A:
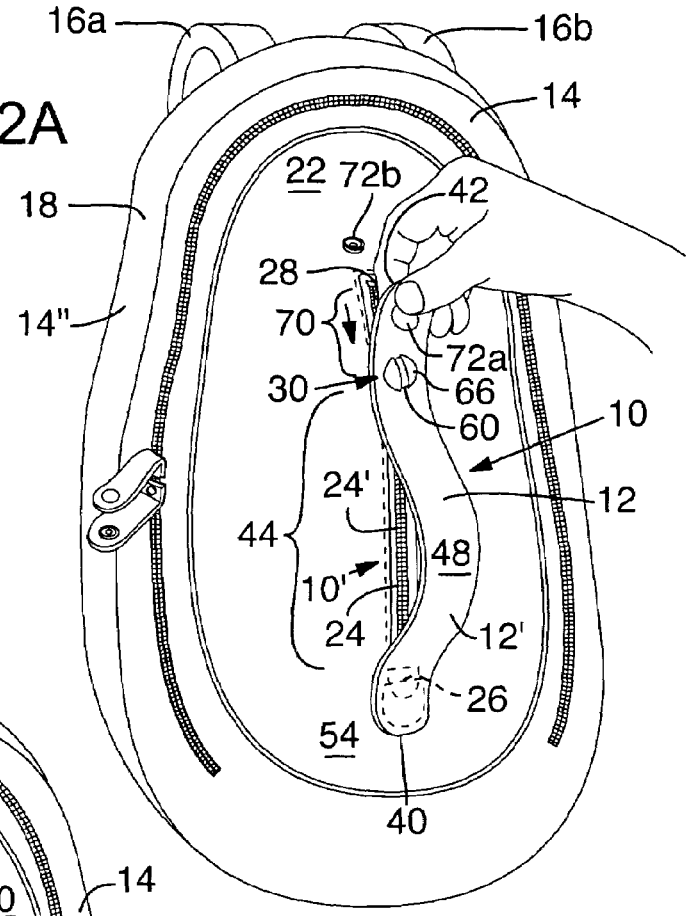
FIG. 2A is a front, isometric view of the article of FIG. 1 showing a possible movement of the pull with respect to the article.
Figure 2B:
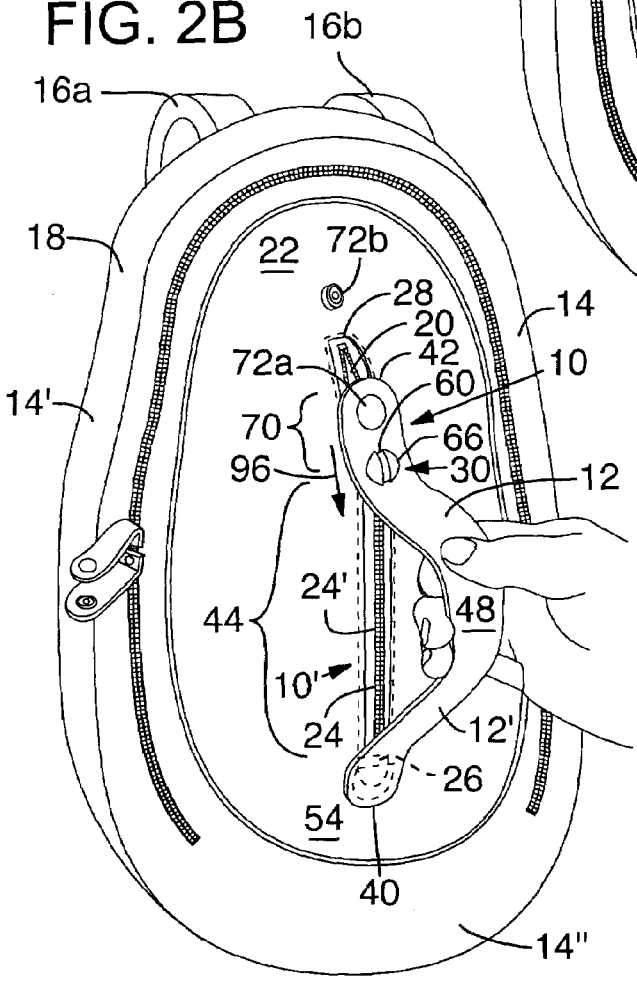
FIG. 2B is a front, isometric view of the article of FIG. 1 showing a possible user grasp of the pull.
Figure 2C:
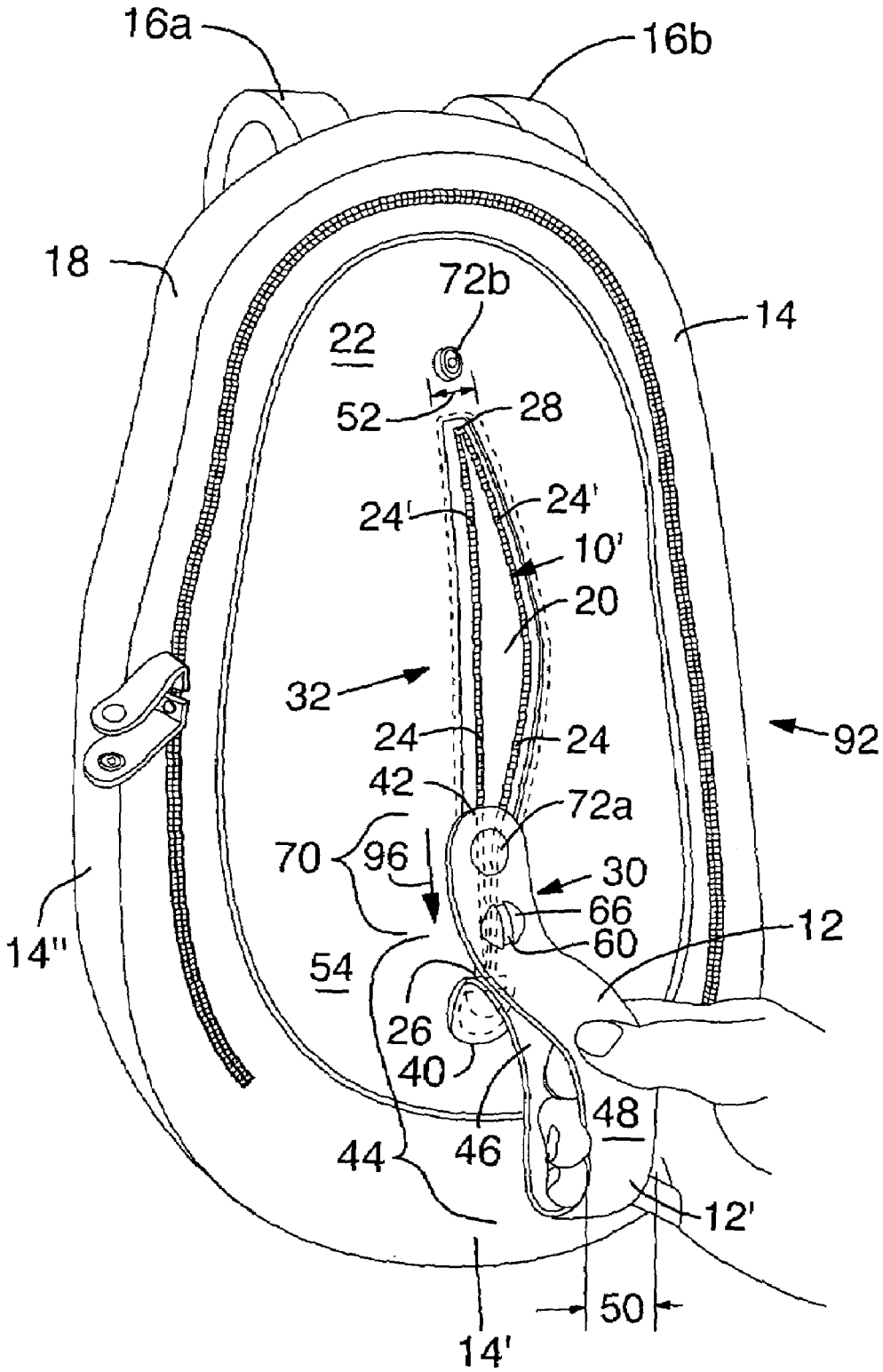
FIG. 2C is a front, isometric view of the article of FIG. 1 showing a possible open position of the slide fastener and pull.
Figure 3:
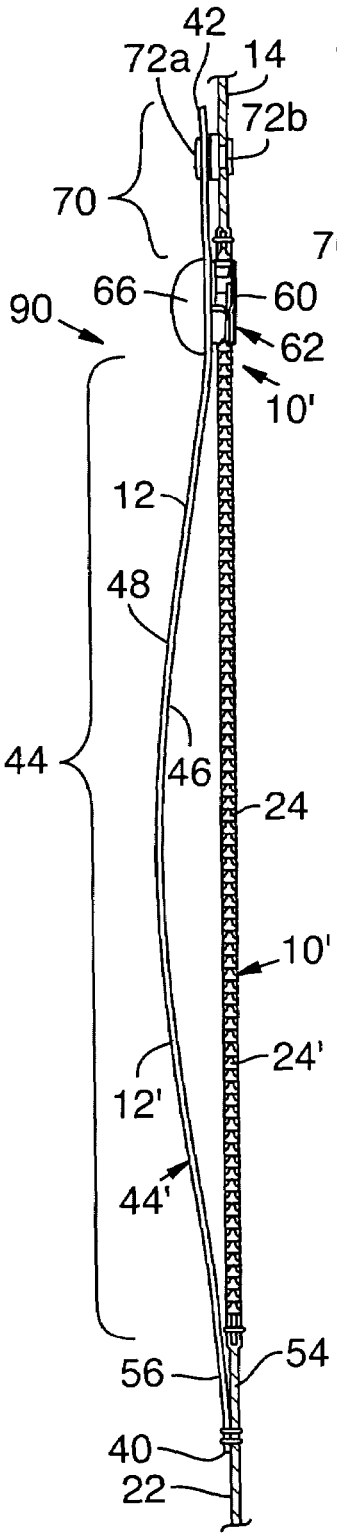
FIG. 3 is a fragmentary, side view of the slide fastener and pull of FIG. 1 in a possible closed position.

As shown in FIGS. 1 and 3, the slide fastener 10 has a pair of elongate, substantially parallel-aligned engaging portions 24 defining a base end 26 and an opposite end 28 of the slide fastener 10. The pair of elongate engaging portions 24 operably engage each other as a slide 30 is moved along their longitudinal length. The pair of elongate engaging portions 24 are attached to the flexible container 18 adjacent to an opening 32 (FIG. 2C) in the flexible container 18 thereby allowing the chamber 20 within the flexible container 18 to be opened or closed by opening and closing the slide fastener 10. Preferably the slide fastener 10 is a zipper 10', and the pair of substantially parallel-aligned elongate engaging portions 24 is a set of alternating zipper teeth 24'.

Referring to FIG. 1, the pull 12 of the slide 30 is an elongate, preferably flexible, strip 12' that has a first end 40 and an opposite second end 42 forming a graspable handle portion 44 therebetween. Preferably, the strip 12' is substantially planar thereby defining an interior planar surface 46 and an exterior planar surface 48. More preferably, the pull 12 is formed of a wear and water resistant material such as treated leather, plastic, or the like, and the pull 12 has a width 50 (FIG. 1) that is wider than the width 52 (FIG. 1) of the elongate slide fastener 10.

The pull 12 is attached to the article 14 between the handle portion 44 and the first end 40. Preferably, this attachment is substantially rigidly secured and positioned adjacent to the base end 26 of the slide fastener 10 such that the interior planar surface 46 is positioned adjacent to a planar surface 54 on the article 14. More preferably, the adjacent area of the exterior planar surface 48 remains exposed, thereby providing a visibly distinct surface for displaying surface ornamentation 56, such as a company logo or the like, thereon.

Figure 5:
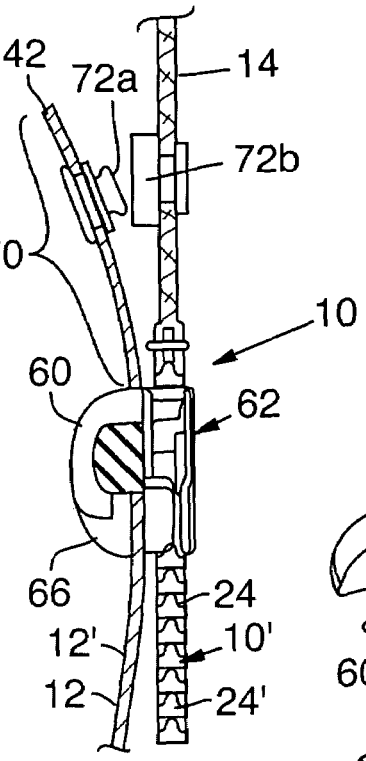
FIG. 5 is an enlarged, fragmentary, side view of the slide fastener and pull of FIG. 2A.
Figure 6:
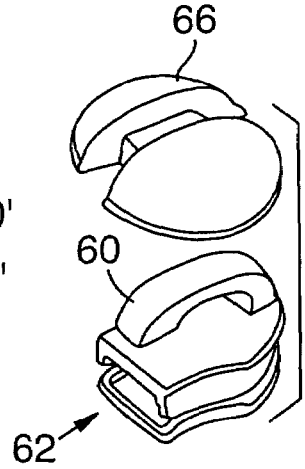
FIG. 6 is an isometric, exploded view of a slider assembly in accordance with an embodiment of the present invention.

The slide 30 for the slide fastener 10 is operably secured to the pull 12 between the handle portion 44 and second end 42 as shown in FIGS. 1 and 3. Preferably and as shown in FIGS. 3, 5 & 6, the slide 30 includes a hook-shaped protrusion 60 extending from an engaging portion connector 62 that operably engages the pair of engaging portions 24 on the slide fastener 10. The engaging portion connector 62 is mounted adjacent to the interior planar surface 46 of the pull 12 such that the hook-shaped protrusion 60 extends through the pull 12 to the exterior planar surface 48 of the pull 12. A relatively large stopper 66 is positioned adjacent to the exterior planar surface 48 of the pull 12 and between the hook-shaped protrusion 60 and the pull 12 thereby securing the slide 30 to the pull 12.

Preferably, the slide 30 is secured to the pull 12 at a location spaced apart from the second end 42 of the pull 12, thereby defining a tab portion 70 of the pull 12 from the slide 30 to the second end 42. More preferably, this tab portion 70 is detachably secured to the article 14 at a location substantially adjacent to the opposite end 28 of the slide fastener 10 as shown in FIG. 1. For example, the tab portion 70 can include a snap fastener 72*a* that operably engages a mating snap protrusion 72*b* extending from the article 14.

Figure 4:
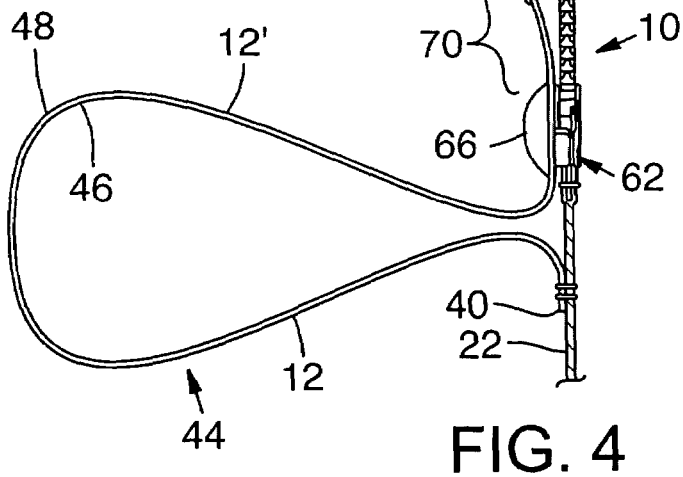
FIG. 4 is a fragmentary, side view of the slide fastener and pull of FIG. 2C in the possible open position.

Having described the pull 12 and slide fastener 10 in relationship to an exemplar article 14 to which they are attached, it can be appreciated that the pull 12 and related slide fastener 10 can be positioned in a closed position 90 as shown in FIGS. 1 and 3 or an open position 92 as shown in FIGS. 2C and 4. In the closed position 90, the pull 12 extends over the engaging portions 24 of the slide fastener 10 from the base end 26 to the opposite end 28 of the slide fastener 10. Accordingly, the pull 12 serves as a cover for the slide fastener such that the interior planar surface 46 of the pull lies substantially adjacent to the engaging portions 24 of the slide fastener 10, thereby protecting the engaging portions 24 of the slide fastener 10 and hiding the slide fastener 10 from view. The slide 30 is positioned adjacent to the opposite end 28 of the slide fastener 10, thereby maintaining the slide fastener in the closed position 90.

Preferably, the tab portion 70 is detachably secured to the article 14 when the pull 12 is in the closed position 90. Accordingly and as shown in FIG. 1, the handle portion 44 of the pull can serve as a storage device 44'. For example, a separate article 94, such as a jacket, towel or pair of shoes, can be inserted through the area between the handle portion 44 and the article 14, thereby allowing the separate article 94 to hang from the pull 12. Detachably securing the tab portion 70 maintains the pull 12 in its closed position 90 and prevents the weight of the separate article 94 hanging from the handle portion 44 of the pull 12 from inadvertently urging the pull 12 and related slide fastener 10 toward an open position 92 (FIG. 2C).

Referring to FIGS. 2A–2C, an exemplar method for using the pull 12 to open the slide fastener 10 is shown. As shown in FIG. 2A, to open the slide fastener 10, a user first detaches the tab portion 70 of the pull 12 from the article 14. The user then grasps the handle portion 44 of the pull 12, and using it like a pull-chord, moves the attached slide 30 toward the base end 26 of the slide fastener 10 in the direction of arrow 96. This action causes the slide 30 to move toward the base end 26, thereby opening the slide fastener 10. Depending on the intended purpose for the article to which the pull 12 and slide fastener 10 will be attached, the length of the handle portion 44 is preferably sized so as to form a loop of material that may be easily grasped by physically challenged individuals, people wearing gloves, or the like.

Referring to FIGS. 2C and 4, the pull 12 and slide fastener 10 have reached their fully open position 92 when the slide 30 reaches an area adjacent to the base end 26 of the slide fastener 10.

To close the slide fastener 10, the user reverses this process. First, the user grasps the loop of material defining the handle portion 44 shown in FIG. 2C and urges the slide 30 in a direction opposite from the direction of arrow 96. This causes the slide 30 to move toward the opposite end 28 of the slide fastener 10, thereby closing the slide fastener 10 as it proceeds toward the opposite end 28.

With the slide 30 positioned substantially adjacent to the opposite end 28 of the slide fastener 10, the user can detachably secure the tab portion 70 of the pull 12 to the article 14, thereby securing the slide fastener 10 in its closed position 90.

The pull 12 and related slide fastener 10 of this invention has a wide variety of applications and uses. For example, when the article 14 to which the slide fastener 10 and pull 12 are applied is outdoor gear, such as a backpack 14", a user can open and close a chamber 20 in the backpack 14" during inclement weather without removing their mittens or gloves to grasp the pull 12. The pull 12 can also provide an easy storage device for an additional jacket or the like. Similarly, when the article 14 is a sports bag or the like, wet or soiled articles such as a bathing suit, a pair of shoes, or towel can held by the pull outside the bag, thereby preventing articles in the bag from becoming wet or soiled. The slide fastener 10 and pull 12 can also be substituted for existing slide fasteners on a wide variety of other articles to assist physically challenged individuals and the like with opening and closing these articles.

In view of the wide variety of embodiments to which the principles of the invention can be applied, it should be apparent that the detailed description of a preferred embodiment is illustrative only and should not be taken as limiting the scope of the invention. For example, it can be appreciated that the principles of this invention would work equally well if the slide fastener 10 and pull 12 were applied to any other article that normally has slide fasteners therein. These articles include articles of apparel 98 (FIG. 7) such as outerwear 102 (FIG. 7) and the like, articles of footwear 100 (FIG. 8), and other zippered or zip-lock type containers.

Figure 7:
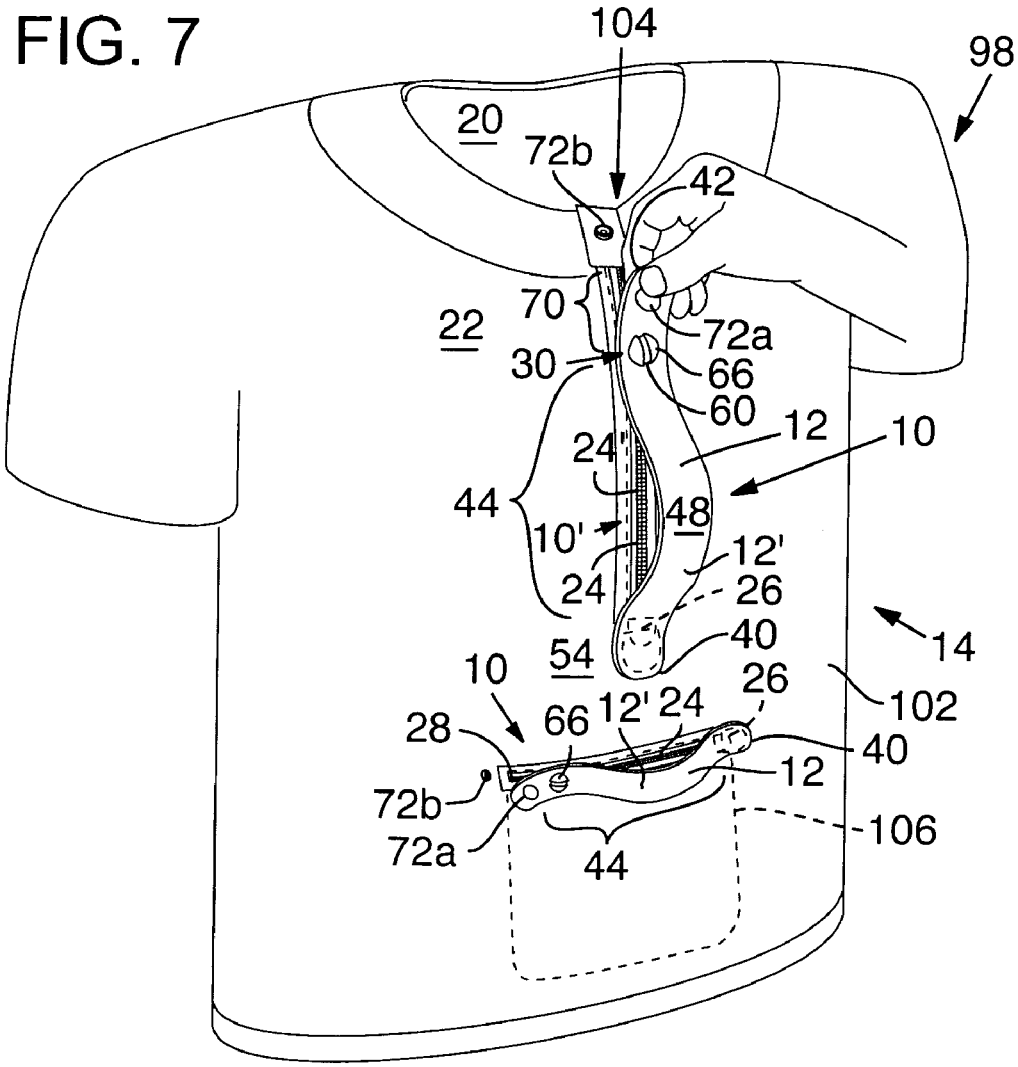
FIG. 7 is a front, isometric view of an article of apparel having two slide fasteners, each with a pull in accordance with an embodiment of the present invention.

Referring to FIG. 7, two preferred uses of the slide fastener 10 and pull 12 are shown operably secured to a wearable covering forming an article of apparel 98, such as a coat or the like. In first preferred use, the slide fastener 10 and pull 12 are operably secured to the apparel's main opening 104, thereby allowing a wearer to easily open and close the article of apparel 98 to permit easy donning and removal thereof. In a second preferred use, the slide fastener 10 and pull 12 are operably secured to a pocket 106 on the article of apparel 98, thereby allowing easy opening and closing of the pocket, 106 even by a physically challenged individual or by an individual wearing gloves or the like.

Figure 8:
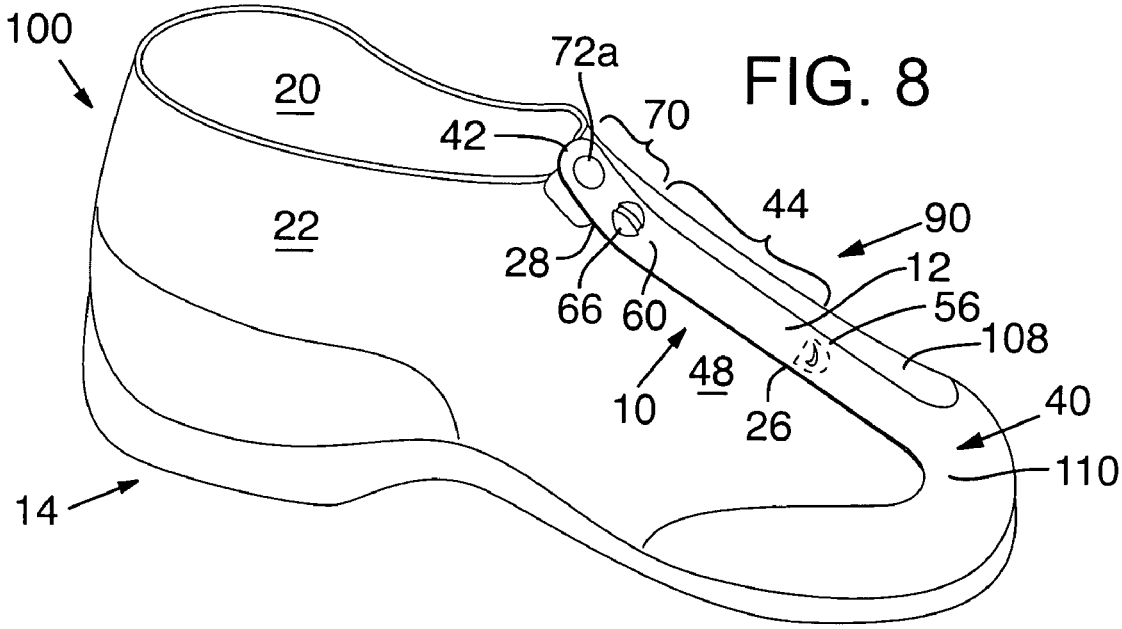
FIG. 8 is a side, isometric view of an article of footwear having a slide fastener with a pull in accordance with an embodiment of the present invention.

Referring to FIG. 8, the slide fastener 10 and pull 12 are shown operably secured to a wearable foot covering forming an article of footwear 100, such as a shoe, boot, slipper or the like. Preferably, the slide fastener 10 and pull 12 operate as a replacement to a conventional lace closing structure on the upper 108 of the article of footwear 100. More preferably, the pull is formed from an extension of a toe portion 110 of the upper 108. It can be appreciated that a wearer of the article of footwear 100 can easily secure the article of footwear 100 to his or her foot or remove the article 100 from his or her foot simply by operating the slide fastener 10 and pull 12 as previously described.

In addition, while the preferred orientation of the slide fastener 10 is substantially vertical when the slide fastener 10 and pull 12 are attached to a book bag, it should be appreciated that the principles of this invention will work equally well in any other orientation depending on the intended purpose for the article to which the slide fastener 10 and pull 12 are attached. Similarly, while the disclosed preferred structure for detachably securing the tab portion of the pull to the article is a snap fastener 72*a*, other structures such as hook and loop material and the like, can be used for this purpose.

Accordingly, the claimed invention includes all such modifications as may come within the scope of the following claims and equivalents thereto.

What is claimed is:

1. A slide fastener for opening and closing a chamber of an article, said slide fastener comprising:

an elongate pair of engaging portions positioned adjacent to an opening in the article;

a slide operably secured to said pair of engaging portions such that said slide joins said engaging portions together when moved in a first direction and disengages said engaging portions when moved in a opposite second direction; and, an elongate flexible pull having a first end and a second end, said pull attached to said article toward said first end, said slide rigidly secured to said pull toward said second end defining a handle portion between said slide and said first end and a tab portion from said slide to said second end, wherein said tab portion is shorter than said handle portion.

2. The slide fastener of claim 1, further including a fastener operably secured to said tab portion thereby allowing said tab portion to be detachably secured to said article.

3. The slide fastener of claim 2, wherein said slide fastener has an opened position and a closed position, and said tab portion is detachably secured to said article when said slide fastener is in said dosed position.

4. The slide fastener of claim 3, wherein said pull defines a storage device when said tab portion is detachably secured to said article wherein objects positioned between said engaging portions and said handle portion are operably secured to said article.

5. The slide fastener of claim 1, wherein said pull is a substantially planar member.

6. The slide fastener of claim 5, wherein:

said elongate pair of engaging portions has a first width;

said substantially planar member has a second width; and, said second width is at least as wide as said first width thereby allowing said pull to cover said elongate pair of engaging portions.

7. The slide fastener of claim 1, wherein said pull is a monolithic elongate strip of material.

8. The elide fastener of claim 1, wherein said slide fastener has a base end and an opposite end, and said pull is attached to said article substantially near said base end.

9. The slide fastener of claim 1, wherein:

a substantially planar surface defines where said pull is attached to said article; and, surface indicia is applied to an exterior surface of said substantially planar surface.

10. The slide fastener of claim 1, wherein said slide fastener is a zipper.

11. The slide fastener of claim 1, wherein said slide fastener and said pull are aligned substantially vertically on said article.

12. The slide fastener of claim 1, wherein said article is an article of luggage.

13. The slide fastener of claim 12, wherein said article of luggage is a backpack having shoulder straps.

14. The slide fastener of claim 1, wherein said article is an article of apparel.

15. The slide fastener of claim 14, wherein said article of apparel is outerwear.

16. The slide fastener of claim 14, wherein said article of apparel has a main opening, and said slide fastener and pull are operably secured to said main opening.

17. The slide fastener of claim 14, wherein said chamber is a pocket attached to said article of apparel, and said slide fastener and pull are operably secured to said pocket.

18. The slide fastener of claim 1, wherein said article is an article of footwear.

19. The slide fastener of claim 18, wherein said article of footwear has an upper and said slide fastener and pull are operably secured to an opening in said upper.

20. An article of luggage comprising:

a container defining a chamber therein;

a slide fastener for opening and dosing the chamber, said slide fastener having an open position and a closed position;

a slide engaging the slide fastener to operably transition between said open position and said closed position; and, an elongate flexible pull having a first end and a second end, said pull attached to said article toward said first end, said slide rigidly secured to said pull toward said second end defining a handle portion between said slide and said first end and a tab portion from said slide to said second end, wherein said tab portion is shorter than said handle portion.

21. The article of luggage of claim 20, wherein said tab portion is detachably secured to said article with a fastener when said slide fastener is in said closed position.

22. The article of luggage of claim 21, wherein said pull defines a storage device when said tab portion is detachably secured to said article wherein objects positioned between said engaging portions and said handle portion are operably secured to said article.

23. The article of luggage of claim 20, wherein said pull is a monolithic elongate strip of material aligned substantially vertically on said luggage.

24. An article of luggage comprising:

a container defining a chamber therein;

a slide fastener for opening and closing the chamber, said slide fastener having an open position and a closed position;

a slide engaging the slide fastener to operably transition been said open position and said closed position; and, an elongate flexible pull having a first end and a second end, said pull attached to said article toward said first end, said slide rigidly secured to said pull toward said second end defining a handle portion between said slide and said first end;

wherein said pull is a substantially planar member having a first width, and said slide fastener has a second width, said first width is larger than said second width such that said pull covers said slide fastener when said slide fastener is in said closed position.

25. A slide fastener for opening and closing a chamber of an article of footwear having an upper, said slide fastener comprising:

an elongate pair of engaging portions positioned adjacent to an opening in the article of footwear;

a slide operably secured to said pair of engaging portions such that said slide joins said engaging portions together when moved in a first direction and disengages said engaging portions when moved in a opposite second direction;

an elongate pull having a first end and a second end, said pull attached to said article of footwear toward said first end, said slide operably secured to said pull toward said second end defining a handle portion between said slide and said first end; and, said pull is formed from a toe portion of said upper.

26. An article of footwear comprising:

a wearable foot covering having an opening therein;

a slide fastener operably secured adjacent to said opening, said slide fastener having an open position defining a base end of said slide fastener and a dosed position defining an opposite end of said slide fastener;

a slide engaging the slide fastener to operably transition between said open position and said closed position; and, an elongate flexible pull having a first end and a second end, said pull attached to said article of footwear toward said first end and positioned substantially adjacent to said base end of said slide fastener, said slide rigidly secured to said pull toward said second end defining a handle portion between said slide and said first end.

27. The article of footwear of claim 26, wherein:

said slide is spaced apart from said second end defining a tab portion from said slide to said second end, and, said tab portion is detachably secured to said article with a fastener when said slide fastener is in said closed position.

28. The article of footwear of claim 26, wherein said opening is in an upper of the article of footwear and said slide fastener is operably secured adjacent to said opening.

29. The article of footwear of claim 26, wherein said article of footwear has an upper and said pull extends from a toe portion of said upper.

30. An article of apparel comprising:

a wearable covering having an opening therein;

a slide fastener operably secured adjacent to said opening, said slide fastener having an open position and a dosed position;

a slide engaging the slide fastener to operably transition between said open position and said closed position; and, an elongate flexible pull having a first end and a second end, said pull attached to said article of apparel toward said first end, said slide rigidly secured to said pull toward said second end defining a handle portion between said slide and said first end and a tab portion from said slide to said second end, wherein said tab portion is shorter than said handle portion.

31. The article of apparel of claim 30, wherein said tab portion is detachably secured to said article with a fastener when said slide fastener is in said closed position.

32. The article of apparel of claim 30, wherein said opening is a main opening of said article of apparel and said slide fastener is operably secured adjacent to said main opening whereby the main opening may be opened or dosed with said slide fastener.

33. The article of apparel of claim 30, wherein said wearable covering defines an article of outerwear.

34. The article of apparel of claim 30, wherein said wearable covering includes a pocket therein, and said slide fastener and pull are operably secured to said pocket.

35. A pull for a slide fastener attached to an article, the slide fastener having a base end, an opposite end, an elongate pair of engaging portions, and a slide for operably engaging the pair of elongate engaging portions, said pull comprising:

an elongate strip of substantially planar material attached to the article toward said base end;

the slide operably secured to said pull toward said opposite end, thereby defining a handle portion of the elongate strip of material between said pull and said baser end.

36. A pull for a slide fastener attached to an article, the slide fastener having an open position and a closed position, a base end, an opposite end, an elongate pair of engaging portions defining a first width, and a slide for operably engaging the pair of elongate engaging portions, said pull comprising:

an elongate strip of material attached to the article toward said base end;

the slide operably secured to said pull toward said opposite end, thereby defining a handle portion of the elongate strip of material between said pull and said base end; and, wherein the pull has a second width at least as wide as said first width.

37. The pull for a slide fastener of claim 36, wherein said elongate strip of material is substantially planar defining an interior surface and an exterior surface, said exterior surface having surface ornamentation thereon.

38. The pull for a slide fastener of claim 35, wherein the slide fastener has an open position and a closed position, and said handle portion forms a loop of material when the slide fastener is in said open position.

* * * * *